United States Patent [19]

MacNeil

[11] 4,121,797

[45] Oct. 24, 1978

[54] CHILDREN'S BOTTLE AND TOY HOLDER

[76] Inventor: Thomas R. MacNeil, 43D Memorial Dr., Weymouth, Mass. 02188

[21] Appl. No.: 812,714

[22] Filed: Jul. 5, 1977

[51] Int. Cl.[2] ..... A47D 15/00

[52] U.S. Cl. ..... 248/102

[58] Field of Search ..... 248/102, 103, 104, 105, 248/106, 107; 297/188; 46/32, 53; 297/153

[56] References Cited

U.S. PATENT DOCUMENTS

| | | | |
|---|---|---|---|
| 1,232,690 | 7/1917 | Keenan | 248/103 |
| 1,369,928 | 3/1921 | Lockwood | 248/103 |
| 1,501,080 | 7/1924 | Wickham | 248/102 |
| 1,863,163 | 6/1932 | Malti et al. | 248/102 |
| 3,251,626 | 5/1966 | Martin | 248/103 |
| 3,978,610 | 9/1976 | Stubbmann | 248/102 |

FOREIGN PATENT DOCUMENTS

| | | | |
|---|---|---|---|
| 1,348,536 | 12/1963 | France | 297/153 |

*Primary Examiner*—Albert A. Hafer

[57] ABSTRACT

A device for holding an infant's feeding bottle, toy or the like. The device includes a pair of spaced end members extending from a support and having means of removeably engaging a holder. Several different holders may be utilized for engaging or supporting the feeding bottle, the toy, etc. Alternatively, the holder can be provided with means of engaging a bottle and a toy simultaneously.

2 Claims, 4 Drawing Figures

CHILDREN'S BOTTLE AND TOY HOLDER

BACKGROUND OF THE INVENTION

The use of a holder for a child's nursing bottle which is attached to a child's support such as a baby carriage is disclosed in the Neumann U.S. Pat. No. 1,030,744 issued June 25, 1912. The holder uses a rod which is clamped to two spaced upstanding members and which has a supporting bar extending therefrom to clamp the bottle in a rigid relationship to the feeding child. The patent to Bailey, U.S. Pat. No. 2,457,972 issued Jan. 4, 1949 discloses a nursing bottle holder which is hooked over the side of a crib to hold the bottle in rigid relation to the feeding child.

These early patents attempted to overcome the necessity of manually holding a nursing bottle while the child was feeding, by holding the bottle in a position to feed the child while rigidly preventing any displacement of the bottle from the feeding position.

The U.S. Pat. to Parent, No. 2,530,478 issued Nov. 21, 1950; Gillaspy, No.2,605,069 issued July 29, 1952; Silagyi No. 2,944,779 issued July 12, 1960; Alloy No. 3,151,828 issued Oct., 1964; Flanigan No. 3,182,942 issued May 11, 1965; Paglee No. 3,298,649 issued Jan. 17, 1967; Bennyhoff No. 3,342,443 issued Sept. 19, 1967 and Mariner No. 3,635,431 issued Jan. 18, 1972, all disclose bottle holding devices which rigidly fix the bottle in relation to the feeding child. None of the mentioned prior art devices provide for the possibility that an infant might start to choke on the feeding beverage. That is, there is no method for the infant to remove the bottle from its mouth once it is in position.

It would seem that the patent to Delvecchio, et al, U.S. Pat. No. 3,410,512, attempts to overcome the problem of rigidity by utilizing a flexible arm, however the bottle is still held in a clamp.

The Walsh patent U.S. Pat. No. 2,637,515 issued May 5, 1953 attempts to overcome the rigid relationship between the bottle and the feeding child by utilizing a flexible strap as a holder.

Both DelVecchio, et al and Walsh disclose that children's toys may be positioned on the holder. There is no indication in either patent that separate removeable holders can be utilized for holding toys or a feeding bottle.

SUMMARY OF THE INVENTION

This invention relates to a device for supporting a children's instrumentality such as a nursing bottle or toy.

The device is used with a child suport such as an infant seat, bassinet, and the like and includes an end member which extends upwardly from each side of the support, for example, from the arms of the seat. Each of the end members has a free terminal end or portion that has an engagement means formed or associated therewith adapted to removeably position a holder across the area between the end members. Separate holders can be utilized each of which is adapted to engage one or more instrumentalities.

The holder for the infant's bottle has a depressed, arced central or saddle portion and has proximate each of its terminal ends a circumferential groove adapted for removable snap engagement with the end members.

A holder for children's toys may be substituted for the bottle holder thereby increasing the useful life of the device.

The bottle is held by an edge of the saddle portion and the child's mouth during feeding, although it may rest fully on the saddle portion.

The holder having the saddle portion may include engagement grooves for engaging a toy holder thereby avoiding the necessity of substituting one holder for another.

BRIEF DESCRIPTION OF THE DRAWINGS

The invention will be described in detail, by way of example, with reference to the accompanying drawing in which.

DETAILED DESCRIPTION OF THE PREFERRED EMBODIMENTS

Figure 1:
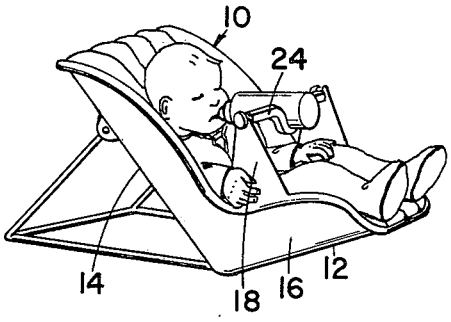
FIG. 1 is a perspective view of an infant's seat showing the bottle holder of the present invention in use.
Figure 2:
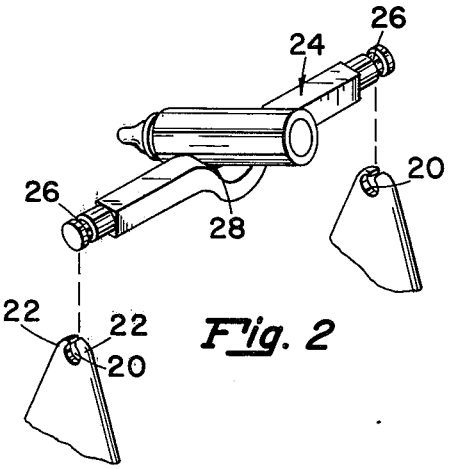
FIG. 2 is an exploded perspective view of the bottle holder shown in FIG. 1.
Figure 3:
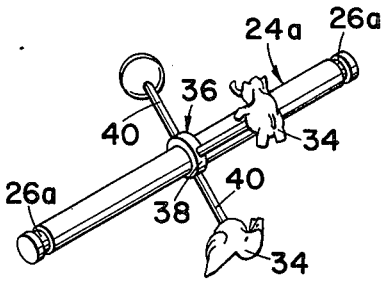
FIG. 3 is a perspective view of a toy holder of the instant invention.

There is shown in the drawings and particularly in FIGS. 1 and 2 a conventional supporting means 10 for holding an infant in an inclined position. For example, the types of infant seats shown in U.S. Pat. Nos. 3,184,193; 3,342,443 and 3,635,431 could be utilized with the instant invention. The supporting means 10 includes a back having a bottom portion 12 and an inclined rear wall 14 providing a continuation of the bottom portion 12 and a side or side wall 16 extending upwardly from each side edge of the back. The back and sides define a tray-like configuration. A substantially triangular end member 18 extends, in integral relation, upwardly from each of the upper surfaces of the portions of the sides 16 extending from the bottom 12. The apex or upper portion of the outer surface of each of the end members 18 is depressed downwardly to provide an arced recess 20, as a securing means open on two sides and having each of its opposed spaced walls shaped to provide a flexible finger 22. The distance between the terminal ends of the fingers 22 is less than the diameter of the recess 20. The fingers 22 are adapted to flex away from each other to accept and restrain a holder 24.

Generally the holder 24 comprises a substantially rigid rod-like support portion having a circumferential attachment groove 26 formed in close proximity to each of its terminal ends. For use as an infant bottle holder the central portion of the holder 24 is depressed to provide an arced saddle portion 28 whose diameter is greater than the diameter of the infant bottle, but which will prevent excess movement of the bottle along the holder 24. When positioned on the end members 18 the upper edge of the basal portion of the saddle portion 28 closest to the rear wall 14 of the supporting means 10 is adapted to function as a support edge.

Figure 4:
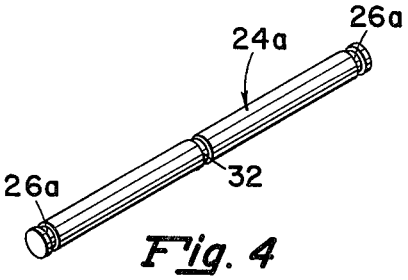
FIG. 4 is a perspective view of the support rod of the toy holder of FIG. 3.

The holder may also be constructed as a toy holder **24*a* by forming one or more circumferential engagement grooves 32 on the support rod between attachment grooves 26*a* positioned and formed similarly to the attachment grooves 26 and omitting the saddle portion 28 as shown in FIG. 4. Attachment of children's toys 34 to the holder 24*a* is accomplished through a connector 36 having a flexible ring element 38 from the outer periphery of which a series of spaced arms 40 radiate. A toy 34 is fixed to the free terminal end of each of the arms 40. Engagement between the connector 36 and the holder 24***a* is achieved by stretching the ring element 38, whose inner diameter is slightly smaller than the diameter of the support rod, around the support rod element and sliding it to an engagement groove 32. The width of the ring element 38 is less than the width of the engagement groove 32 permitting a "snap" engagement between the two parts. The dimensions of the ring element 38 and the engagement groove 32 can be adjusted to allow the connector 36 to freely rotate about the long axis of the holder 24*a* with the application of a small force or to require the application of a greater force to rotate the connector 36 thereby enabling a preselected toy 34 to be positioned in front of the child.

If desired the holder 24 may be modified by adding one or more engagement grooves similar to the engagement grooves 32 between an attachment groove 26 and the saddle portion 28 on either or both sides of the saddle portion 28. These additional grooves are used to engage a connector similar to the connector 36, for the same purpose.

In use for feeding, the child is positioned in the supporting means 10 and each attachment groove 26 of the holder 24 is passed between the fingers 22 of the end member 18 into the recess 20. The engagement of the holder 24 with the recess 20 prevents unintended rotation of the holder 24 around its long axis and faces the opening of the saddle portion 28 away from the supporting means 10. The position of the child is adjusted, using pillows, for example, if necessary, so that his mouth will comfortably reach the nipple of a feeding bottle which is placed on the support edge, although for most children the use of pillows is not necessary. The child's head will then be below the horizontal plane of the basal or lower part of the saddle portion 28 permitting gravity to assist in liquid feeding. While feeding, the bottle is held by the support edge and the mouth of the child. Any violent movement of the child's head which may be caused by his discomfort will cause the bottle to disengage from the saddle portion 28 and fall within the supporting means 10 probably beside the child. The possibility of the child choking without being able to remove the nipple from its mouth, a danger with many other bottle holders, is thereby substantially avoided. Obviously, the necessity of manually holding the bottle during feeding is eliminated. When feeding is completed, the holder 24 is disengaged and the toy holder 24*a* may be engaged providing amusement for the child. If a holder is utilized that includes both the saddle portion and a connector with toys, no substitution of holders is necessary. As shown in FIG. 2 the width of the holder 24 is less than the length of the bottle.

What I claim is:

1. A device for holding a child's feeding bottle, the device comprising a support having two upstanding walls spaced from each other, an end member extending upwardly from each of the walls and a substantially rigid, rod-like holder having terminal ends, a circumferential, first attachment groove formed proximate one terminal end and a circumferential second attachment groove forward proximate the other terminal end, and having a depressed area located between the terminal ends forming a saddle providing the means of engaging the feeding bottle, each of the end members having an upper portion, and one of the end members having its upper portion including a first recess having flexible spaced opposed walls and the upper portion of the other end member including a second recess having flexible spaced walls, the first attachment groove adapted to removeably engage the first recess and the second attachment groove adapted to removeably engage the second recess thereby providing a removeable engagement between the holder and the end members.

2. A device for holding a child's toy, the device comprising a support having two upstanding walls spaced from each other, an end member extending upwardly from each of the walls, each of the end members having an upper portion, a substantially rigid, rod-like holder having terminal ends, a circumferential engagement groove formed between the terminal ends and a circumferential, first attachment groove formed proximate one terminal end and a circumferential second attachment groove formed proximate the other terminal end, the upper portion of one of the end members including a first recess having flexible spaced opposed walls and the upper portion of the other end member including a second recess having flexible spaced opposed walls, the first attachment groove adapted to removeably engage the first recess and the second attachment groove adapted to removeably engage the second recess thereby providing a removeable engagement between the holder and the end members.

* * * * *